US005658224A

United States Patent [19]

Betrock

[11] Patent Number: 5,658,224

[45] Date of Patent: Aug. 19, 1997

[54] SWIM PADDLE

[76] Inventor: Irving Betrock, 14001 E. Palomino Dr., Fort Lauderdale, Fla. 33330

[21] Appl. No.: 700,275

[22] Filed: Aug. 20, 1996

Related U.S. Application Data

[60] Provisional application No. 60/002,858, Aug. 28, 1995.

[51] Int. Cl. [6] ..... A63B 31/10

[52] U.S. Cl. ..... 482/55; 482/105; 441/58

[58] Field of Search ..... 482/55, 105, 111; 441/56–58; 434/254

[56] References Cited

U.S. PATENT DOCUMENTS

| | | | |
|---|---|---|---|
| 1,655,762 | 1/1928 | Englehart . | |
| 1,708,331 | 4/1929 | Ryan | 441/58 |
| 2,078,068 | 4/1937 | Eustis . | |
| 2,389,196 | 11/1945 | Harmon . | |
| 2,555,969 | 6/1951 | Holcombe . | |
| 3,765,042 | 10/1973 | Montrella . | |
| 4,913,418 | 4/1990 | Schlueter . | |

*Primary Examiner*—Richard J. Apley
*Assistant Examiner*—John Mulcahy
*Attorney, Agent, or Firm*—Alvin S. Blum

[57] ABSTRACT

A swim paddle is attached by elastic loops to the palm of a swimmer's hand to increase hydrodynamic resistance. The paddle extends beyond the sides of the hand and is relieved on the thumb side so as to leave the two distal phalanges free to move. The paddle is relieved on the bottom edge so as to leave the wrist joint free to move. The paddle extends at the top edge only to the proximal phalanges of the fingers so that the distal two phalanges of the fingers and thumb are free to use while the paddle is in place on the hand. A discoidal weight is removably attachable to the paddle for enhanced training effect as desired.

15 Claims, 2 Drawing Sheets

SWIM PADDLE

This application is based upon Provisional application Ser. No. 60/002,858 filed Aug. 28, 1995, now abandoned.

FIELD OF THE INVENTION

This invention relates to training aids for swimmers and more particularly to swim paddles that attach to the hands for increased hydrodynamic resistance with removable weight.

BACKGROUND OF THE INVENTION

Among the prior art devices are hand paddles which are intended to be attached to the back of the hand. When the hand is moved on the power stroke, the paddle resistance will force the paddle away from the hand and the forces will be transmitted to the straps or bindings and then to the hand through a narrower contact which may be injurious and uncomfortable.

U.S. Pat. No. 4,913,418 issued Apr. 3, 1990 to Schlueter et al. discloses a paddle of the type that is attached to the palmar surface of the hand. It is held in place by a rubber loop at the base of a finger and a rubber loop at the wrist. The paddle is forced against the palm on the power stroke. The paddle is larger than the outstretched hand with perforations approximating the hand size. One of these paddles is readily applied or removed by the wearer when the other hand is unencumbered by a paddle. However, when a hand is encumbered by one of these paddles, the thumb and fingers are no longer available for applying or removing a paddle from the other hand. Furthermore, it is more awkward to adjust goggles, swimsuit, scratching, or even climbing in an out of the pool when the paddles are in place.

SUMMARY OF THE INVENTION

It is accordingly an object of the invention to provide a swim paddle that is arranged to apply to the palm of the hand to create hydrodynamic resistance on the power stroke. It is another object that the device when in place not interfere with the use of the thumb and fingers. It is another object that an improved attachment be provided to distribute the forces applied to the back of the hand. It is yet another object to provide a removable weight on the paddle to further enhance its training features.

The paddle of the invention comprises a rigid panel applied against the palmer surface having a width greater than the width of the hand with a portion of one side relieved to admit the thumb and permit its free motion. The bottom edge is relived to permit free pivot motion of the wrist and the top edge is arranged to not extend beyond the first phalange of each finger when the device is properly positioned. The paddle is attached by rubber tubes which cross over the back of the hand and a tube which loops across the wrist. A flat discoidal disc weight is removably attached to the paddle to lie flat against the paddle by rubber tube, bolt or the like. These and other objects, advantages and features of the invention will become more apparent when the detailed description is studied in conjunction with the drawings.

DETAILED DESCRIPTION OF PREFERRED EMBODIMENTS

Figure 3:
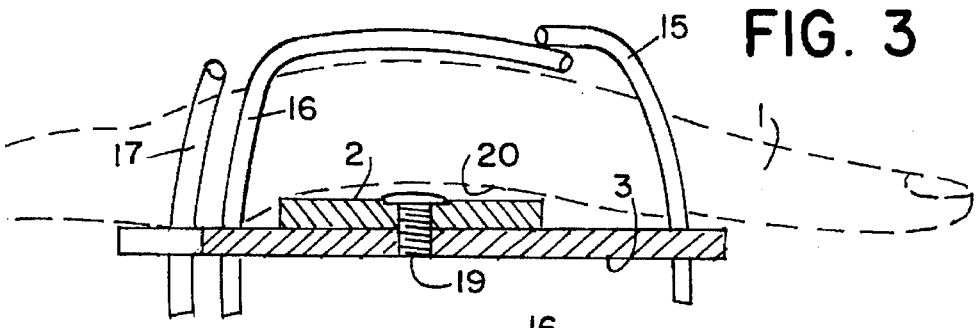
FIG. 3 is a sectional view taken through line 3—3 of FIG. 1.
Figure 2:
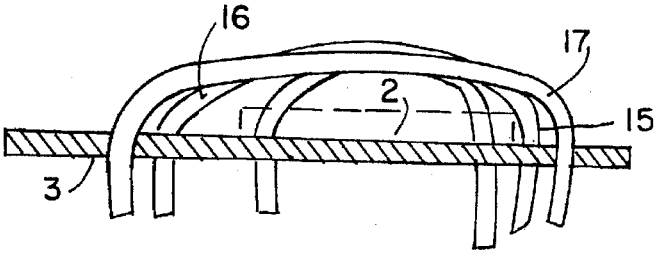
FIG. 2 is a sectional view taken through line 2—2 of FIG. 1.
Figure 1:
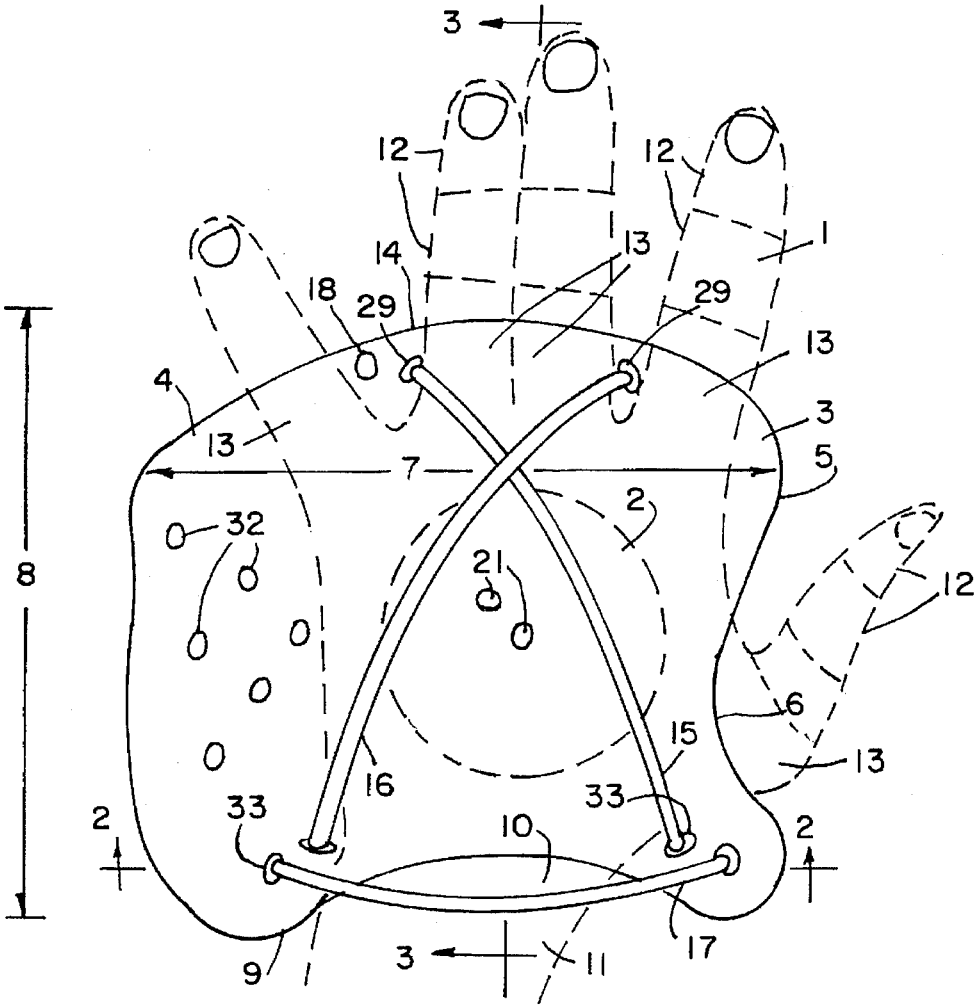
FIG. 1 shows the paddle in plan view.

Referring now to FIGS. 1–3, a hand 1 in phantom is shown in place in FIGS. 1 and 3 and a disc weight 2 is shown in phantom in FIGS. 1 and 2 and solid in FIG. 3.

A rigid plate 3, about 2 mm thick, preferably of a plastic such as polycarbonate is cut in the shape shown with a width 7 greater than the palm, extending beyond the little finger side in flange 4 with perforations 32, and beyond the thumb side in a flange 5 provided with a relief or recess 6 so as to not extend beyond the proximal phalange 13 of the thumb, thereby allowing free motion of the two distal phalanges 12 and joints.

The length 8 of the plate extends from the wrist to the proximal phalanges 13 of the fingers. The wrist margin 9 of the plate is relieved by recess 10 to permit unhindered motion of the wrist 11. By only extending at the finger margin 14 to the proximal phalanges 13, the two distal phalanges 12 and their joints are permitted unhindered motion as well so that the fingers and opposed thumb may be used while the device is in place.

The paddle is held in place by elastic cords or tubes including two tubes 15 and 16 which cross over the dorsum of the hand, and wrist loop 17. These tubes pass thru smaller diameter holes in the plate. The length of the loops may be adjusted by pulling more or less of the tube through the hole. This tube securing means is simple, convenient and well known in the art. By providing extra mounting holes such as 18, further adjustment to hand size may be made. By having the tubes cross over the back of the hand, the holding forces are distributed over a greater skin area to thereby reduce stress. The power stroke forces the plate 3 against the palm to distribute force broadly over the stronger palmar surface. The surface area of the plate is large enough to greatly increase the hydrodynamic resistance so that the training swimmer can exert greater force in training. The wrist loop 17 may also be adjusted to suit individual requirements without creating so much tension that is constricts circulation.

The heavy weight 2 may optionally be fastened to the plate 3 by removable fastening means such as the bolt 19 such that the weight is held securely between the palm 20 and the plate. Other fastening means well known in the art such as hook and loop fasteners (not shown) may be used as well. Multiple mounting holes 21 may be provided to adjust the weight location for greatest effectiveness.

The swim paddle comprises a substantially rigid, thin panel having opposed broad front and back faces and narrow edges. The edges include opposed top and bottom edges, and opposed side edges. The bottom edge or wrist margin is provided with a relieved recess to permit unhindered pivotal motion of the wrist joint. The top edge or finger margin is arranged to extend only to the proximal phalanges of the fingers, thereby allowing free motion of the last two distal phalanges and joints of the four fingers. The side edges are arranged to extend beyond both sides of the palm, including a thumb side relieved so as to not extend beyond the first phalange of the thumb and a little finger side that is perforated. The panel is provided with adjustable elastic attaching means which pass through apertures in the panel and may be pulled through the apertures to a greater or lesser extent to adjust tightness as required. The attaching means includes a wrist loop attached to the panel at both sides of the wrist, and two separate loops which are arranged to cross over the back of the hand, a first loop extending from an aperture 33 on one side of the wrist to an aperture 29 adjacent the top edge at a first interdigital location, and a second loop extending from an aperture 33 on the other side of the wrist to another aperture 29 at a second interdigital location. The attaching means pulls the back face of the panel against the palm of the user. A broad flat weight may be removably attached by fastening means to the back of the panel to lie between the palm and the panel. The fastening means may be any well known fastening means including bolts and hook and loop fasteners that may be position adjustable.

Figure 4:
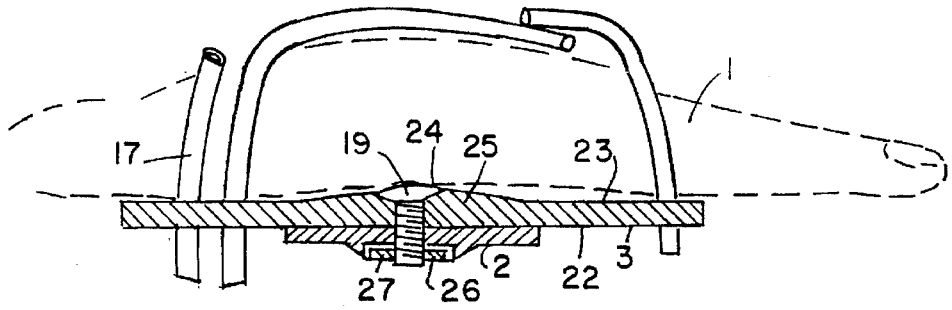
FIG. 4 is a sectional view, as in FIG. 3, of another embodiment of the invention.

Referring now to FIG. 4, another embodiment of the invention is shown, in which the heavy weight 2 is removably attached to the plate 3 on the broad face 22 of plate 3 that is away from the hand receiving broad face 23. The plate 3 is thickened at 25 and provided with a countersunk hole 24 so as to comfortably receive a flat head bolt 19. The weight 2 may be provided with a recess 26 to receive nut 27 and prevent its turning so that only a screwdriver is needed to change weights. No sharp edges or fastener protrusions are exposed to injure the user.

Figure 5:
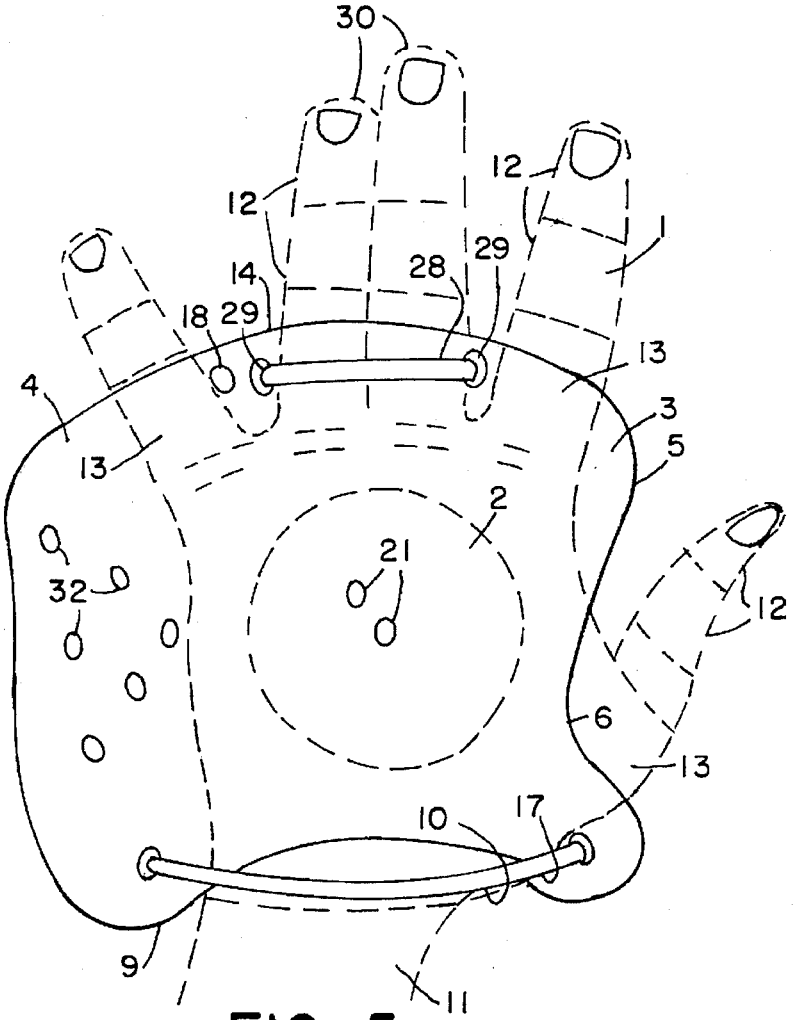
FIG. 5 is a plan view of another embodiment of the invention.

Referring now to FIG. 5 another embodiment of the invention includes a different configuration for the rubber tubes holding the plate 3 in place on the hand 1. A single loop 28 is rubbery tubing passed through apertures 29 extends across the two inner fingers 30 to combine with the wrist loop 17 to hold the paddle to the hand with the plate against the palm.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A swim paddle to be removably attached to the palmar surface of a swimmer's hand while leaving the distal two phalanges of the fingers and thumb and the wrist joint free to move, the paddle comprising:

a substantially rigid, thin panel having opposed broad front and back faces and narrow edges, the edges including opposed top and bottom edges and two opposed side edges, a little finger side edge and a thumb side edge, the thumb side edge relived by a first recess for enabling free motion of the distal two phalanges of the thumb;

the bottom edge being relieved by a second recess for enabling free motion of the wrist joint;

the top edge being spaced from the bottom edge for engaging the proximal flanges of the fingers, thereby enabling free motion of the distal two flanges of the fingers;

a first pair of apertures formed within the panel adjacent the bottom edge;

a first elongate elastic member conducted through the first pair of apertures for forming a wrist loop to be located about a swimmer's wrist;

a second pair of apertures formed within the panel adjacent the top edge;

a third pair of apertures formed within the panel;

a second elongate elastic member conducted through one of the second pair of apertures and one of the third pair of apertures to form a first hand loop;

a third elongate elastic member conducted through the other of the second pair of apertures and the other of the third pair of apertures to form a second hand loop;

the first and second hand loops being adapted to elastically engage the dorsum of the hand and cooperate with the wrist loop to hold the palm of the hand against the first broad face of the panel with the top edge engaging the proximal phalanges of the fingers and the thumb side edge at the first recess engaging the proximal phalange of the thumb such that the little finger side edge and the thumb side edge extend beyond the palm to thereby create increased hydrodynamic resistance.

2. The paddle according to claim 1 further comprising at least one flat discoidal weight and attaching means on the panel intermediate the edges for removably attaching the weight.

3. The paddle according to claim 2, in which the attaching means comprises a threaded fastener.

4. The paddle according to claim 2, in which the attaching means comprises hook and loop fasteners.

5. The paddle according to claim 1 further comprising perforations formed in the panel adjacent the little finger side edge.

6. The paddle according to claim 1, in which the second pair of apertures are located so as to straddle the two inner fingers when the paddle is attached to the swimmer's hand.

7. The paddle according to claim 6, in which the first and second hand loops cross each other.

8. A swim paddle to be removably attached to the palmar surface of a swimmer's hand while leaving the distal two phalanges of the fingers and thumb and the wrist joint free to move, the paddle comprising:

a substantially rigid, thin panel having opposed broad front and back faces and narrow edged, the edges including opposed top side edge and a thumb side edge, the thumb side edge relieved by a first recess for enabling free motion of the distal two phalanges of the thumb;

the bottom edge being relieved by a second recess for enabling free motion of the wrist joint;

the top edge being spaced from the bottom edge for engaging the proximal flanges of the fingers, thereby enabling free motion of the distal two flanges of the fingers;

a first pair of apertures formed within the panel adjacent the bottom edge;

a first elongate elastic member conducted through the first pair of apertures for forming a wrist loop to be located about a swimmer's wrist;

at least one additional pair of apertures formed in said panel;

at least one additional elongate elastic member conducted through the at least one additional pair of apertures to form at least one hand loop, the at least one hand loop adapted to pass through the panel adjacent the top edge and through at least one interdigital space between two of the fingers when attached to the swimmer's hand, the at least one hand loop being adapted to elastically engage the dorsum of the hand and cooperate with the wrist loop to hold the palm of the hand against the first broad face of the panel with the top edge engaging the proximal phalanges of the fingers and the thumb side edge at the first recess engaging the proximal phalange of the thumb such that the little finger side edge and the thumb side edge extend beyond the palm to thereby create increased hydrodynamic resistance.

9. The paddle according to claim 8 further comprising at least one flat discoidal weight and attaching means on the panel intermediate the edges for removably attaching the weight.

10. A swim paddle to be removably attached to the palmar surface of a swimmer's hand while leaving the distal two phalanges of the fingers and thumb and the wrist joint free to move, the paddle comprising:

a substantially rigid, thin panel having opposed broad front and back faces and narrow edges, the edges including opposed top and bottom edges and two opposed side edges, a little finger side edge and a thumb side edge, the thumb side edge relieved by a first recess for enabling free motion of the distal two phalanges of the thumb;

the bottom edge being relieved by a second recess for enabling free motion of the wrist joint;

the top edge being spaced from the bottom edge for engaging the proximal flanges of the fingers, thereby enabling free motion of the distal two flanges of the fingers;

a first pair of apertures formed within the panel adjacent the bottom edge;

a first elongate elastic member conducted through the first pair of apertures for forming a wrist loop to be located about a swimmer's wrist;

a second pair of apertures formed within the panel adjacent the top edge;

a second elongate elastic member conducted through the second pair of apertures to form a loop engaging the dorsal surface of the proximal phalanges of the two inner fingers of the hand and cooperating with the wrist loop to hold the palm of the hand against the first broad face of the panel with the top edge engaging the proximal phalanges of the fingers and the thumb side edge at the first recess engaging the proximal phalange of the thumb such that the little finger side edge and the thumb side edge extend beyond the palm to thereby create increased hydrodynamic resistance.

11. The paddle according to claim 10 further comprising at least one flat discoidal weight and attaching means on the panel intermediate the edges for removably attaching the weight.

12. The paddle according to claim 11, in which the attaching means comprises a threaded fastener.

13. The paddle according to claim 11, in which the attaching means comprises hook and loop fasteners.

14. The paddle according to claim 10 further comprising perforations formed in the panel adjacent the little finger side edge.

15. The paddle according to claim 10, in which the second pair of apertures are located so as to straddle the two inner fingers when the paddle is attached to the swimmer's hand.

* * * * *